United States Patent [19]

Tadewald

[11] 3,973,103

[45] Aug. 3, 1976

[54] WOOD VENEER RADIANT HEATING PANEL

[75] Inventor: Thomas D. Tadewald, La Crosse, Wis.

[73] Assignee: Universal Oil Products Company, Des Plaines, Ill.

[22] Filed: Apr. 21, 1975

[21] Appl. No.: 569,897

[52] U.S. Cl. ..... 219/543; 219/345; 219/528; 219/548

[51] Int. Cl.[2] ..... H05B 3/16

[58] Field of Search ..... 219/213, 345, 528, 543, 219/544, 548, 549; 338/212

[56] References Cited

UNITED STATES PATENTS

| | | | |
|---|---|---|---|
| 2,458,184 | 1/1949 | Marick | 219/543 X |
| 2,521,540 | 9/1950 | Richardson | 219/345 |
| 2,540,295 | 2/1951 | Schreiber | 219/213 |
| 2,621,279 | 12/1952 | Richardson | 219/345 X |
| 2,623,150 | 12/1952 | Boecher, Jr. et al. | 219/345 X |
| 2,889,439 | 6/1959 | Musgrave | 219/345 |
| 2,952,761 | 9/1960 | Smith-Johannsen | 219/544 X |
| 3,651,386 | 3/1972 | Youtsey et al. | 317/237 |
| 3,657,516 | 4/1972 | Fujihara | 219/345 |
| 3,697,728 | 10/1972 | Stirzenbecher | 219/544 X |
| 3,757,087 | 9/1973 | Bernard | 219/549 |

*Primary Examiner*—Volodymyr Y. Mayewsky
*Attorney, Agent, or Firm*—James R. Hoatson, Jr.; Philip T. Liggett; William H. Page, II

[57] ABSTRACT

A wood veneer laminate form of heating panel incorporates an internal layer of a semiconductive carbonaceous pyropolymer, consisting of carbon and hydrogen on a high surface area refractory inorganic oxide support, to provide electrical resistance radiant heating. The carbonaceous pyropolymer in powder form can be incorporated with the glue line between veneer or core stock layers or mixed with a resin to be impregnated into a glass-cloth, or other support material, to form a conductive prepreg sheet which can be placed between wood veneer layers.

1 Claim, 3 Drawing Figures

WOOD VENEER RADIANT HEATING PANEL

Figure 1:
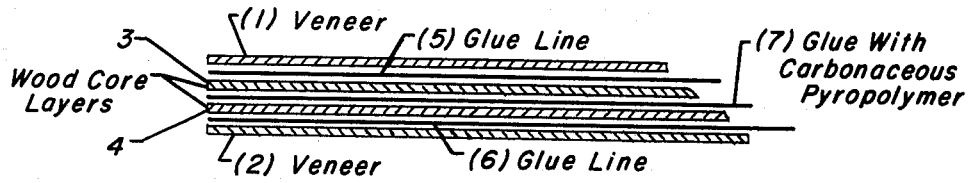

The present invention relates to an improved wood veneer laminate form of heating panel containing a semiconductive carbonaceous pyropolymer to provide electrical resistance radiant heating.

More specifically, the invention is directed to a radiant panel type of heater which makes use of a glue line between veneer layers or a plastic laminate supporting structure to provide an advantageous means for incorporating therein an electrical resistance heat producing layer of carbonaceous pyropolymer, consisting of carbon and hydrogen bonded with a high surface area inorganic oxide support.

It is, of course, known that there are many forms of electrical heating panels which are in use to provide radiant heat for various usages. For example, there are various forms of metallic or metal coated sheets which can provide resistance heating. There are also various types of heating plates or panels which employ embedded wiring in the manner of electrically heated blankets. In still other instances, there are resistors which are made from compressed powder mixes that are, in turn, made from carbon or other semiconductor materials, as well as the small types of resistors which embody the depositions of carbon or graphite particles, carbon inks, etc., as part of the "thick film" technology. However, it is not known that there has been the previous usage of semiconductive layers in combination with a glue line or within plastic laminate prepreg sheet for use between veneer layers in the manufacture of heating panels having an external wood veneer layer.

The electrical conductivity of a material necessarily falls into one of three categories: conductors, semiconductors, or insulators. Conductors are those materials generally recognized to have a conductivity greater than about $10^2$ inverse ohm-centimeters, while insulators have a conductivity no greater than about $10^{-10}$ inverse ohm-centimeters. Materials with a conductivity between these limits are generally considered to be semiconducting materials. In this instance, the invention is directed to the use of a special pseudo-metallic composite as a semiconductor material and in particular, to a semiconductive composition prepared in accordance with the teachings of U.S. Pat. No. 3,651,386, so as to impart uniformity and quality to the resulting heater panel.

A principal object of this invention is to provide an improved form of radiant heating panel by incorporating a layer of a semiconducting carbonaceous pyropolymer into a right laminate panel such that electrical power to the conductive layer will produce electrical resistance heating and the desired radiant heat affect.

It is a further object of the invention to make use of an improved form of semiconductive carbonaceous pyropolymer in the glue line or in a core layer of the panel with the pyropolymer resulting from the heating of an organic pyrolyzable substance on a high surface area refractory inorganic oxide substrate. It may also be considered an object of the present invention to provide for combinations of wood veneer and plastic laminate sheets in the resulting radiant heating panel.

In a broad aspect, the present invention embodies a multiple layer, wood veneer containing laminate form of radiant heating panel incorporating a semiconductive layer, which comprises in combination, at least two layers of wood veneer sheeting for said panel, thermosetting adhesive means between the plurality of layers of said panels, at least one internal layer in said panel containing a semiconductive carbonaceous pyropolymer formed from the heating of an organic pyrolyzable substance on a high surface area inorganic oxide substrate, and electric current supply means to spaced apart portions of said layer of conductive carbonaceous pyropolymer to provide for electrical resistance heating therein and for a resulting radiant heat producing panel.

In a more specific aspect, the invention embodies the use of a carbonaceous pyropolymer which has been formed by heating an organic pyrolyzable substance in a primarily non-oxidizing atmosphere and in contact with a refractory inorganic oxide material at a temperature above about 400° C. such that the resulting semiconductive composition will have a conductivity of from about $10^{-8}$ to about $10^2$ inverse ohm-centimeters.

Illustrative examples of the refractory oxides which may be used will include alumina in various forms such as gamma-alumina and silica-alumina. In addition, it is also contemplated that the refractory oxide may be preimpregnated with a catalytic metallic substance such as platinum, platinum and rhenium, platinum and germanium, platinum and tin, platinum and lead, nickel and rhenium, tin, lead, germanium, etc.

Examples of organic substances which may be pyrolyzed to form the pyropolymer on the surface of the aforementioned refractory oxides will include aliphatic hydrocarbons, cycloaliphatic hydrocarbons, aromatic hydrocarbons, aliphatic halogen derivatives, aliphatic oxygen derivatives, aliphatic sulfur derivatives, aliphatic nitrogen derivatives, heterocyclic compounds, organometallic compounds, carbohydrates, etc. Some specific examples of these organic compounds which may be pyrolyzed will include ethane, propane, butane, pentane, ethylene, propylene, 1-butene, 2-butene, 1-pentene, 2-pentene, 1,3-butadiene, isoprene, cyclopentane, cyclohexane, methylcyclopentane, benzene, toluene, the isomeric xylenes, naphthalene, anthracene, chloromethane, bromomethane, chloroethane, bromoethane, chloropropane, bromopropane, isopropane, chlorobutane, bromobutane, isobutane, carbon tetrachloride, chloroform, 1,2-dichloroethane, 1,2-dichloropropane, 1,2-dichlorobutane, ethyl alcohol, *n*-propyl alcohol, isopropyl alcohol, *n*-butyl alcohol, sec-butyl alcohol, *t*-butyl alcohol, glycol, glycerol, ethyl ether, isopropyl ether, butyl ether, ethyl mercaptan, *n*propyl mercaptan, butyl mercaptan, methyl sulfide, ethyl sulfide, ethyl methyl sulfide, methyl propyl sulfide, dimethyl amine, diethyl amine, ethyl methyl amine, acetamide, propionamide, nitroethane, 1-nitropropane, 1-nitrobutane, acetonitrile, propionitrile, formic acid, acetic acid, oxalic acid, acrylic acid, formaldehyde, acid aldehyde, propionaldehyde, acetone, methyl ethyl ketone, methyl propyl ketone, ethyl propyl ketone, methyl formate, ethyl formate, ethyl acetate, benzyl chloride, phenol, *o*-cresol, benzyl alcohol, hydroquinone, resorcinol, catechol, anisole, phenetole, benzaldehyde, acetophenone, benzophenone, benzoquinone, benzoic acid, phenyl acetate acid, hydrocyanmic acid, furan, furfural, pyran, coumarin, indole, dextrose, sucrose, starch, etc. It is to be understood that the aforementioned compounds are only representative of the class of compounds which may undergo pyropolymerization and that the present invention is not necessarily limited thereto.

Generally, the organic compounds are admixed with a carrier gas such as nitrogen or other inert gases, heated and passed over the refractory oxide base. The deposition or compositing of the pyropolymer with the surface of the base material is effected at relatively high temperatures ranging from about 400° to about 900° C. and preferably in a range of from about 600° to about 900° C. It is possible to govern the electrical properties of the pyropolymeric semiconducting organic refractory oxide material by regulating the temperature and the residence time during which the refractory oxide base is subjected to the treatment with the organic pyrolyzable substance. The thus prepared pyropolymeric semiconducting organic refractory oxide material when recovered will possess a resistivity in the range of from about $10^{-2}$ to about $10^{10}$ ohm-centimeters. However, if so desired, the pyropolymeric semiconducting organic refractory oxide material may also be subjected to additional exposure to elevated temperatures ranging from about 900° to about 1200° C. in an inert atmosphere and in the absence of additional pyrolyzable materials for various periods of time, said treatment resulting in the reduction of the electrical resistivity of the lowest resistivity powders by as much as six orders of magnitude. While the above material describes one specific method of preparing a pyropolymeric semiconducting organic refractory oxide material, it is to be understood that we do not wish to be limited to this method of preparing said material and that any suitable method in which the carbonaceous material is formed or composited with the surface of a refractory oxide material may also be utilized to form the desired filler.

The pyropolymer may be mixed with a suitable thermosetting vehicle to permit the spreading thereof as a generally separate layer within the interior of the resulting veneer laminate panel; however, preferably, the carbonaceous pyropolymer can be admixed directly with the adhesive for the "glue lines" or adhesive layers between veneer sheets. Various types of adhesives may be used in assembling plywood layer, i.e., animal glues, vegetable glues, protein adhesives, such as from casein, soy proteins, etc., and various synthetic adhesives. The latter are most commonly used because they can resist water and microbial attack, and generally comprise various of the phenolic resins, resorcinol-formaldehyde resins, urea-formaldehyde resins, and the like. It is, however, not intended to limit the present invention to the use of any one adhesive material in forming the radiant heating panel. The conductive carbonaceous pyropolymer filler particles will generally be milled or otherwise formed to be less than 100 microns in size and preferably less than about 10 microns. Also, the pyropolymer powder will usually be present in the adhesive in an amount to provide from about 20% to about 80% by weight of the resin.

As an alternative means for incorporating the semiconductive layer into the laminate form of panel, the carbonaceous pyropolymer in the form of small particles, or as a powder, may be admixed with a suitable vehicle so that it may be painted, spread or otherwise applied to a surface of a resin coated glass-cloth, paper, felt, cardboard, etc., as a laminate substrate. The finely divided carbonaceous pyropolymer may be admixed with the resin or polymeric material which is to be impregnated into and coated onto a particular reinforcing matrix which will provide at least one layer of laminate substrate material in the panel. The resulting mixture can be incorporated into and/or onto the substrate from a dipping operation or from a coating procedure and the resulting coated substrate is subjected to semicuring such that the semiconductive pyropolymer results in a uniform impregnation and coating over the resulting semicured laminate sheet. The powdered filler will be present in an amount in the range of from about 80% to about 10% by weight of the filler to the weight of the finished composite with the polymeric material. The amount of carbonaceous pyropolymer to be used in the polymeric material will vary with the conductivity of the particular powdered pyropolymer being used as the filler material and with the conductivity desired for the conductive layer in the resulting panel; however, the amount of filler in proportion to the resin or to the resulting thermoset sheet will generally not vary once an optimum proportion is established.

In the forming of a typical rigid panel of "plastic" laminate material in the conventional manner, without wood veneer layers, a plurality of semicured resin coated and impregnated sheets of glass-cloth, paper, cardboard, felt, etc., (such sheets being generally referred to as "prepreg" sheets) are stacked together and then subjected to both heat and pressure such that there is a full curing of the polymeric material to provide a resulting rigid laminate board. The resulting laminate may vary in thickness, depending upon the number of semicured layers, or prepreg sheets, that are placed together to form a final composite product. Also, laminate panels may comprise a plurality of similar prepreg sheets using the same reinforcing matrix or there may be a composite of various semicured sheets using different reinforcing materials, such as of canvas, glass-cloth, paper, cardboard, felt, etc. Some specific examples of the polymers, that may be used in laminate production, which may be both thermosetting or thermoplastic by nature, will include polyolefins such as polyethylene and polyethylene copolymers, polypropylene and polypropylene copolymers, polystyrene and copolymers, polyvinylacetate, polyvinyl chloride, vinylacetate-vinyl chloride copolymers, polyvinylidene chloride and copolymers, etc., polyesters, polyurethane, polyphenyl ethers, styrenated polyphenyl ethers, polycarbonates, polyamides, polyimides, polyamide-imides, polyoxymethylenes, polyalkylene oxides such as polyethylene oxide, polyacrylates, polymethacrylates and their copolymers with styrene, butadiene, acrylonitrile, etc., epoxy resins, cyanate resins, phthalate based resins, polytetrafluoroethylenes, silicones, butyrated phenolics, acrylonitrile-butadiene-styrene formulations (commonly known as ABS), polybutylene and acrylicester-modified-styrene-acrylonitrile (ASA), alkyd resins, allyl resins, amino resins, phenolic resins, urea resins, malamine resins, cellulose acetate, cellulose acetate butyrate, cellulose nitrate, cellulose propionate, cellulose triacetate, chlorinated polyethers, chlorinated polyethylene, ethyl cellulose, furan resins, synthetic fibers such as the Nylons, Dacrons, Rayons, terylenes, etc.

Of course, in connection with the present invention, the semiconductive carbonaceous pyropolymer will be admixed with one of the foregoing types of materials for impregnating or coating a prepreg sheet to be used in a resulting heating panel, in lieu of admixing the pyropolymer with an adhesive to be used between interior core layers or between a core layer and an outer veneer sheet.

The improved wood veneer laminate form of electrical heating panel, in accordance with the present invention, may be better understood as to construction and arrangement by reference to the accompanying drawing and the following description thereof.

FIG. 1 of the drawing is a diagrammatic sectional view indicating exterior wood veneer and wood core layers in a multiple layer rigid panel having the conductive carbonaceous pyropolymer combined with the glue line between the internal core layers of the panel.

Figure 2:
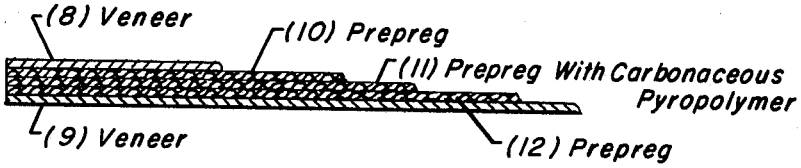

FIG. 2 of the drawing is a diagrammatic sectional view indicating a multiple layer panel having external wood veneer layers and internal prepreg layers, with one of the interior laminate sheets being provided with a semiconductive carbonaceous pyropolymer.

Figure 3:
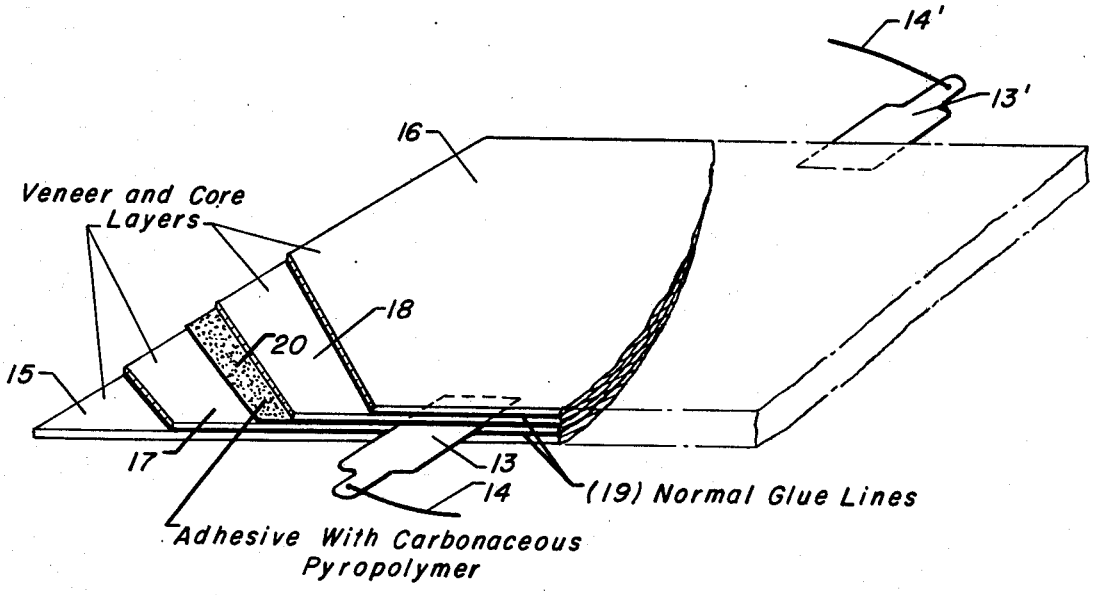

FIG. 3 of the drawing is a partial isomeric view of a multiple layer heating panel where a conductive carbonaceous pyropolymer is combined with the adhesive between internal core layers such that electrical connections to such layer will provide for a resulting radiant heating panel.

Referring now particularly to FIG. 1 of the drawing, there is indicated the provision of external wood veneer layers 1 and 2 with internal wood core layers 3 and 4. There is also indicated the utilization of conventional and suitable adhesive materials at glue lines 5 and 6 respectively between veneer layer 1 and core layer 3, as well as between veneer layer 2 and core layer 4. In the present embodiment, and in accordance with the present invention, there is provided a central adhesive layer 7 which contains a semiconductive carbonaceous pyropolymer formed as hereinbefore described from the compositing of a pyrolyzable organic compound with a refractory inorganic oxide support material.

Typically, for a wood veneer panel member, at least one of the external veneers 1 or 2 will have a finish or a surface decorative such that the panel can be used for decorative purposes. Also, the internal core layers of thin wood veneers can be of varying thickness, or there may be more than two internal core layers in any one panel, with the number of layers depending upon the required strength or the desired thickness for a particular panel. The purely decorative types of wood paneling are usually relatively thin finished panels of approximately ¼ inch or less in thickness. On the other hand, structural panels which may have additional layers can vary in thickness from ¼ to ¾ inch, or even thicker.

As indicated hereinbefore, various types of glues of adhesives may be utilized in the plywood industry and for the manufacture of various types of wood veneer paneling. Thus, the glue line 7 of the present embodiment may vary as to an exact composition and it is not intended to limit the present invention to any one adhesive material. By way of example, the adhesive may comprise a phenolic resin which would be admixed with a sufficient quantity of finely divided carbonaceous pyropolymer in an amount to provide a desired conductivity in a pressed and cured panel so as to in turn result in a desirable form of radiant heating panel. Although not shown in this sectional view, suitable opposing electrical terminal connections would be made to be connective with the central adhesive layer having the carbonaceous pyropolymer in order to distribute electrical current into such layer to provide for resistance heating from the layer.

In FIG. 2 of the drawing, there is indicated the use of external wood veneer sheets 8 and 9 along with a plurality of internal prepreg type laminate sheets 10, 11 and 12. There is also the indication that the central prepreg sheet 11 is provided with a conductive carbonaceous pyropolymer material such that this internal layer can be supplied with electrical energy to, in turn, produce electrical resistance heating. In this type of composite panel, there may be additional suitable adhesive materials utilized between the exterior wood veneer panels and the next adjacent prepreg laminate sheets in order that there will be suitable bond therebetween; however, the usual hot-pressing action carried out at a high temperature of the order of 300° to 350° F. for a continued period of time will provide for the joining of the internal prepreg layers one with the other.

The central prepreg laminate layer 11 with the carbonaceous pyropolymer filler material can be prepared in the manner heretofore set forth, where a suitable glass-cloth material, or other porous substrate, will provide a base for coating and impregnation with a suitable thermosetting polymeric material, as for example, a phenolic resin No. 3098 as prepared by Monsanto Company. The pyropolymer, in turn, will have been prepared by passing a pyrolyzable organic material, such as dextrose, over the surface of a refractory inorganic oxide substrate, such as gamma-alumina in finely divided form, at a temperature of about 900° C. for a period of about ½ hour. The opposite material is then ground in a dried form to obtain particles of a maximum size of about 10 microns and such material then mixed as the filler with the phenolic resin in an amount to provide about 35% by weight of the resin in the admixture. Also, as heretofore noted, such mixture can be coated and impregnated into the sustrate of glass-cloth material and then oven-heated at about 280° F. for a short period of time to provide a semicured or "*b*" stage cure. It is, of course, desirable that the resin and filler material be uniformly coated and impregnated into the reinforcing substrate such that the resulting prepreg sheet will have a substantially uniform composition throughout its entire width and length. Again, although not shown in FIG. 2, a complete radiant heating panel will be provided with suitable electrode or electric energy distribution means to the carbonaceous pyropolymer on the internal prepreg sheet 11 such that there can be electrical resistance heating provided from such sheet and the resulting veneer panel.

FIG. 3 of the drawing provides an isometric or pictorial type of view indicating the placement of opposing electrode members 13 and 13' and electrical current distributing wires 14 and 14' which will provide means for distributing electrical current into the carbonaceous pyropolymer layer of the resulting wood veneer panel. The electrode members 13 and 13' may comprise copper strips which will be embedded into or adjacent the adhesive layer with the carbonaceous pyropolymer; however, it is to be noted that various types of materials and various configurations may well be utilized to effect the distribution of electrical current into the semiconductive layer. For example, copper mesh or copper screening, stainless steel screening or mesh pads, metal felts, etc., may well be utilized to provide the opposing terminals for the introduction of electrical current through the semiconductive layer. In connection with relatively wide heating panels, there will typically be utilized a wide strip of conductive metal material or a plurality of spaced electrode members inserted into the opposing end portions of a semiconductive layer in order to effect a relatively uniform and efficient distribution of current through the entire layer.

For illustrative purposes, there is the indication of external wood veneer layers at 15 and 16 along with internal core layers 17 and 18. There is the further indication of the use of normal adhesives or glue materials at positions 19 between the external veneer layers and the next adjacent core layers; however, in accordance with the present invention, there is indicated the utilization of the special central adhesive layer at 20 which contains the semiconductive carbonaceous pyropolymer material such that the resulting panel can provide electrical resistance heating from current distribution by way of the opposing terminal means 13 and 13' and current supply from distributing wires 14 and 14'.

Again, it is to be noted that the construction and arrangement of FIG. 3 is merely diagrammatic and that additional core layers of wood veneer may be utilized to provide any one size or thickness of wood veneer paneling and that the invention is not to be limited to the utilization of only two internal core layers. Still further, and in accordance with the construction and arrangement of FIG. 2, there may well be the compositing of prepreg laminate sheets such as prepared from the combining of a polymeric material with a porous supporting substrate of glass-cloth, canvas, or whatever.

For placement between wood layers, the adhesive layer 20 may comprise a suitable phenolic resin containing the carbonaceous pyropolymer filler prepared from passing a pyrolyzable organic material into contact with gamma-alumina particulates or other suitable refractory inorganic oxide material, and it is not intended to limit the present invention to any one particular organic material in formingn the composite or any one oxide material. Also, as heretofore set forth, the amount of filler in the adhesive material will vary in accordance with the desired resistivity for the carbonaceous pyropolymer layer with the quantity varying from about 20% to about 80% by weight of the resin, but more generally in the 30% to about 50% range. The normal glue lines at 19 may also comprise a phenolic resin material or any one of the hereinabove noted adhesives which will be thermosetting and, preferably, moisture resistant. As with other veneer boards and rigid laminate panels, there will be a suitable hot pressing of the plurality of laminate sheets for a prescribed suitable period of time in order to effect a resulting rigid panel member. At the time of the hot pressing operation, there will also be the insertion of the suitable electric current distributing electrode means, such as strips 13 and 13', in order that they be tightly sealed into and attached to the carbonaceous pyropolymer layer of the resulting panel for heat producing purposes.

Varying thicknesses for the composites of the panels as well as varying arrangements in the number and types of internal layers of the composite panels, will be obvious to those skilled in the art so as to provide suitable wood veneer types of radiant heat producing panels. The overall size of a panel, as to width and length can vary and, again, it is not intended to limit the present improved form of panel to any one size. In still another aspect, it should be pointed out that a panel can be hot-pressed, or otherwise formed, so as to have a curved configuration over all or a part of its surface area.

I claim as my invention:

1. A multiple layer wood veneer containing laminate form of heating panel comprising at least two layers of wood veneer sheeting, a plurality of wood core layers, a thermosetting adhesive forming a glue line between the plurality of layers of said panel, a filler composition of semiconductive carbonaceous pyropolymer particles less than 100 microns in size, said particles having been formed by heating an organic pyrolyzable substance in a primarily nonoxidizing atmosphere in contact with a refractory inorganic oxide material at a temperature above about 400°C. such that the resulting semiconductive composition will have a conductivity of from about $10^{-8}$ to about $10^{2}$ inverse ohm-centimeters, said filler particles being present in particulate form in admixture with the adhesive forming a glue line between two of said core layers and in an amount of from about 10% to about 80% by weight of said adhesive, and electric current supply means to spaced apart portions of said glue line containing said particles.

* * * * *